US008336856B2

(12) United States Patent
Nelson et al.

(10) Patent No.: US 8,336,856 B2
(45) Date of Patent: Dec. 25, 2012

(54) THREADLESS QUICK CONNECT TUBULAR COUPLING RELEASE TOOL

(75) Inventors: Bryan E. Nelson, Lacon, IL (US); Viral S. Mehta, Peoria, IL (US); Daniel L. Mikrut, Geneva, IL (US); Kirat Shah, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 1011 days.

(21) Appl. No.: 12/241,484

(22) Filed: Sep. 30, 2008

(65) Prior Publication Data

US 2010/0078931 A1 Apr. 1, 2010

(51) Int. Cl.
*E21D 15/44* (2006.01)

(52) U.S. Cl. ..... 254/93 R

(58) Field of Classification Search ..... 254/93 R, 254/89 H, 93 H, 124, 133 R, 104
See application file for complete search history.

(56) References Cited

U.S. PATENT DOCUMENTS

| | | | | |
|---|---|---|---|---|
| 2,446,011 | A * | 7/1948 | Johnson et al. | 173/169 |
| 2,897,703 | A | 8/1959 | Fischer et al. | |
| 2,979,032 | A | 4/1961 | Engquist et al. | |
| 3,081,066 | A | 3/1963 | Murawski | |
| 3,762,688 | A * | 10/1973 | Leonhardt | 254/93 R |
| 3,802,519 | A * | 4/1974 | Newton | 254/93 R |
| 4,791,726 | A | 12/1988 | Ailey, Jr. | |
| 6,000,680 | A | 12/1999 | Kimura et al. | |
| 6,530,559 | B1 * | 3/2003 | Pell | 254/93 R |

OTHER PUBLICATIONS

A Penton Publication, "New Connectors Ease Hydraulic Assembly," Machine Design Magazine, Jun. 5, 2008, vol. 80, No. 11; pp. 82-83.

* cited by examiner

*Primary Examiner* — Hadi Shakeri
(74) *Attorney, Agent, or Firm* — Finnegan, Henderson, Farabow, Garrett & Dunner LLP

(57) ABSTRACT

The presently disclosed embodiment can be characterized as a threadless quick connect coupling release tool having a main body portion fixedly attached to a handle portion, and a head portion having two engagement projection fingers, the head portion being removably attached to the main body portion. An inlet port is coupled to the head portion.

14 Claims, 3 Drawing Sheets

THREADLESS QUICK CONNECT TUBULAR COUPLING RELEASE TOOL

TECHNICAL FIELD

The present disclosure relates generally to work tools. More particularly, the present disclosure relates to release tools used with threadless quick connect tubular couplings, including larger diameter tubular couplings.

BACKGROUND

Threadless quick connect tubular couplings are used in numerous industries including agricultural, construction, forestry, transportation, and utility. Quick connect applications are pervasive and are commonly used on equipment such as power steering lines, pneumatic brakes and air supply lines, transmission oil coolers and heat exchangers, fuel injection systems, hydraulic work circuits, and hydraulic pilot systems. These tubular couplings are found in a wide variety of diameters, anywhere from −4 (¼ inch), up to −32 (2.0 inches) or greater.

Threadless quick connect tubular couplings typically include a male portion in operable engagement with a female portion. These couplings are particularly desirable in locations that are not readily accessible since these couplings often eliminate the need for engaging a threaded connection and the associated danger of cross threading or improper torque.

Larger equipment and systems require larger tubular couplings that generally experience much higher pressure fluid flowing through and across their connections. The volume of flow is typically significantly greater, as well. In order to withstand the higher pressures and flow, larger diameter tubes are required and these threadless quick connect tubular couplings are typically designed with stronger connections, requiring special release tooling to address the higher separating or release forces.

Quick disassembly and disconnection is important when releasing tubing or removing components for maintenance, replacement, and/or repair. A quick disconnection of the joint during production for repair or reconfiguration will save time and money. Enabling a quick disconnection also has significant advantages from a serviceability standpoint, when the equipment is out in the field or with a dealer for repair. A typical step in the disassembly of threadless quick connect tubular couplings is an initial forward push of an insert piece on a release sleeve, or the like, to expand a latch-type ring and disengage the connection. A disconnect tool with adequate leverage (or force) and sufficiently adaptable projections is needed to uncouple the male and female connectors.

For smaller diameter tubular connections, the leverage of the disconnect tool may be enough to move a sleeve forward far enough to make the disconnection. The tools generally available in the industry for this purpose include, for example, a Snap To Connect (STC) disassembly tool set, sold by the Eaton Hydraulics Company of Cleveland, Ohio 44114. The tools are sold in a 5-7-piece set, in order to cover the various standard sized coupling connection diameters, and are disclosed in the April 2004 Eaton Hydraulics STC Connectors brochure. Each tool of the set has a U-shaped opening and a separate specific sized radius tool is needed for each and every individually sized STC coupling hose diameter.

Due to the individual unique sizing for each, the tool has been marked with acute industry service and repair use problems. Generally speaking, use of the prior art tool will not ease operator's ability to disconnect, and it increases the probability of damaging the coupling fittings, and increases the likelihood of operator error from using the wrong sized tool. Further, the one-size-fits-one nature of the tool causes increased production time when an operator has to wait for the right sized tool if the right size is not readily available. This becomes especially critical during servicing the equipment in the field where lack of the right sized tool or a tool strong enough to handle the stronger connection force may create longer repair times and result in customer dissatisfaction.

These and other difficulties experienced with the prior art tools have been obviated in a novel manner by the present disclosure.

SUMMARY

The presently disclosed embodiment can be characterized as a threadless quick connect coupling release tool having a main body portion fixedly attached to a handle portion, and a head portion having two engagement projection fingers, the head portion being removably attached to the main body portion. An inlet port is coupled to the head portion.

Other advantages and novel features of the present disclosure will become apparent from the following detailed description of the disclosure when considered in conjunction with the accompanying drawings.

DETAILED DESCRIPTION

Figure 1A:
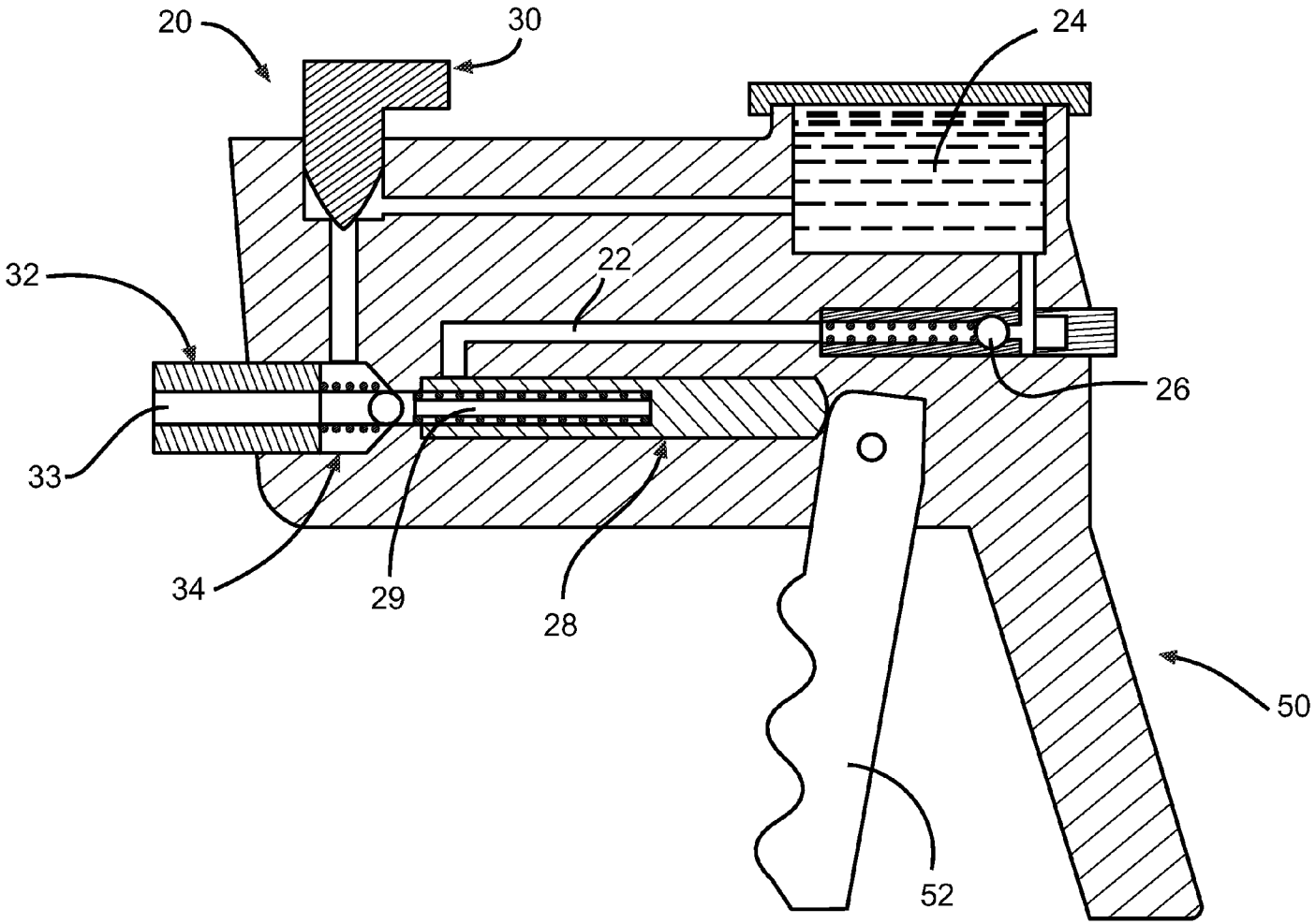
FIGS. 1*a* and 1*b* depict a diagrammatic illustration of a fluid operated threadless quick connect tubular coupling disconnection tool according to an exemplary embodiment of the present disclosure.
Figure 1B:
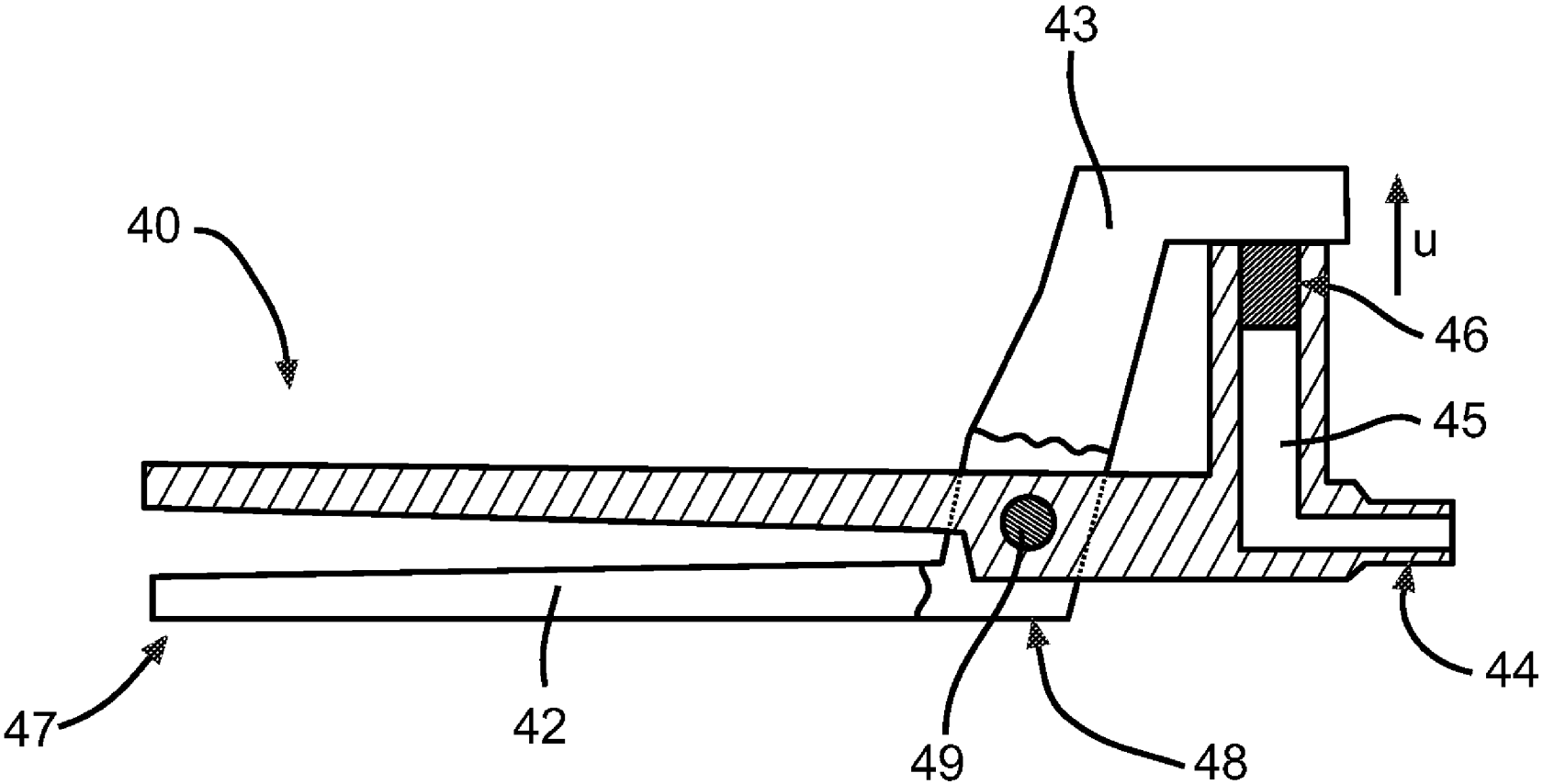
Figure 2:
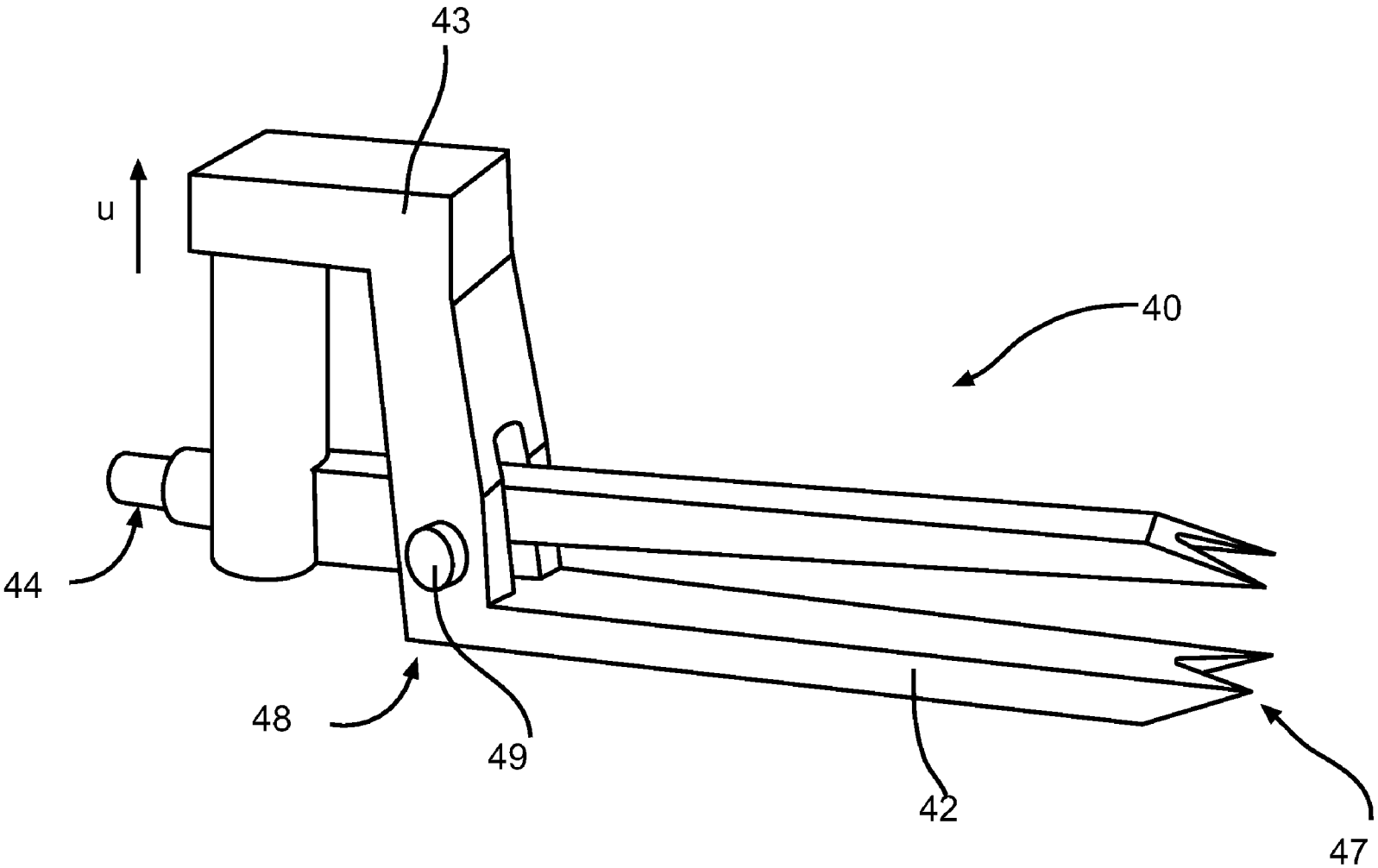
FIG. 2 is a prospective view of a portion of an embodiment of the threadless quick connect tubular coupling disconnection tool of the present disclosure.

Referring to FIGS. 1*a* and 1*b* in detail, an embodiment of the threadless quick connect tubular coupling disconnection or release tool 10 is generally illustrated. The tool 10 has a head portion 40, a main body 20, and a handle portion 50 which are fixedly coupled. The main body portion 20 connects to the head portion 40 via a discharge port 33 in fluid communication with an inlet port 44. The handle portion 50 and the main body portion 20 encompass the bulk of the hydraulic actuation mechanisms. An empowerment means such as a hydraulic hand pump 52 may be arranged on the end of the main portion 20, as would be understood by one skilled in the art. The handle portion 50 may be made of resin, metal, plastic or the like, and may be covered or coated with a comfort-grip material (not shown).

The overall dimensions of the tool may vary according to need; however, the overall width (thickness) of the tool 10 is appropriately sized to move a release sleeve or other threadless connector fitting apparatus forward far enough to make the disconnection, so that prying sideways with the tool 10 is unnecessary. The overall length of the disconnection tool handle 50 is appropriate to hold comfortably in the hand. The dimensions and orientation angles on the head portion 40 may also vary according to need to reach inaccessible areas of the machine and make it most ergonomically friendly for technicians.

In one example of a threadless quick connect tubular coupling, a male shoulder is inserted into a female connector. The male shoulder may spread a latching ring open. When the latching ring is in its open position, the male shoulder can slide past the latching ring. The male shoulder and female connector are then locked into place. As fluid pressure is applied, the latching ring becomes wedged between the male shoulder and the female connector.

During release, the threadless quick connect coupling release tool 10 has engagement projection fingers 42 inserted behind a release sleeve. During a disconnect operation utilizing the release tool 10, the tool is first inserted in the joint to be disconnected, and then the operator squeezes an activation lever 52.

During this squeezing action, fluid in a pumping piston cavity is then pushed through the discharge check valve and through to the discharge port fitting 32. The fluid may be oil, glycol-water mix, or the like. The fluid then travels through the hydraulic line connecting the hand pump to the release tool head portion 40. As the fluid flows into the head portion through the inlet port, it begins to activate the hydraulic piston. The piston then contacts the lever arm of the release tool head portion. The lever arm activates the separation of the two scissor-like finger projections. The separating action then may cause the latching ring to push forward into a groove (not shown) in the female half inner diameter, allowing a male shoulder and a female connector to be disconnected. As is known to those skilled in the art, the release sleeve may be involved with the moving of the latch ring into the aforementioned optional groove.

The release tool 10 may be left inserted to aid disassembly, or immediately released from the threadless quick connect tubular coupling. To help avoid release sleeve tearing, the disconnection tool is slowly inserted and gently pressed open to create an insertion gap. The insertion gap may be created by moving the release sleeve in a release direction using a single projection arm of the threadless quick connect tubular coupling release tool 10, prior to completely inserting the tool 10.

The pumping arm 52 reciprocatingly moves the pumping piston 28 within the cylinder, alternatingly increasing and decreasing the cylinder head space to draw fluid into the pump chamber 29 and then expel liquid from the chamber 29. The main body portion 20 also includes a discharge passageway 33 that provides fluid communication between the main body portion 20 and the head portion 40. The discharge passageway 33 has a discharge check valve 34 that permits fluid to move toward the inlet port 44 and not back toward the chamber 29.

The head portion 40 of the tool has a pair of engagement projection fingers 42 in a scissor like configuration. The engagement projection fingers 42 engage the tubular connection.

The engagement projection fingers 42 have two plane face surfaces that lie at an acute angle to one another and terminate in a transverse edge. The distance between the two plane face surfaces provide the disconnect width needed for disengagement of the connected components of a threadless quick connect tubular coupling.

On the head portion 40 where the opposing inner walls may form steps, each of the steps having a stepped edge. Each edge wall may be aligned directly across from the other on the opposing inner wall.

A suitably shaped actuation handle 52 is connected to the pumping piston 28 to facilitate easy hand actuation. A manually operated rotatable pressure release valve 30 may be used to release pressure and allow retraction of the piston 46. The operator may open the pressure release valve 30, thereby releasing pressure in the cylinder and allowing retraction of the piston 46. After the piston is fully retracted in the cylinder, the head portion 40 may optionally be removed from the main body portion 20.

In an alternative embodiment, the pump diameter or diameter of the piston member is relatively close to the diameter of the conduit tube. When the hydraulic fluid from the pump enters the cavity, a piston ram is pushed forward. As the ram moves forward, it pulls fluid from the reservoir 24 through a filter and a suction check valve behind the rear end of the tool by a suction or vacuum effect. When the ram encounters a predetermined resistance, a low pressure check valve opens and allows the hydraulic fluid to flow into the cavity. Once the pressure in the cavity starts to increase, the suction check valve is forced closed.

As the tool 10 continues to operate through a number of intake and output strokes of the pump, pressure increases. Once the connection is separated, the pressure release valve 30 may be opened. This allows hydraulic fluid to drain back into the reservoir 24 from the head portion 40. Oil, or hydraulic liquid, from the ram cavity and cavity may be drained mechanically through the valve.

A suction check valve 26 may be positioned in the main body portion 20 to permit fluid to be drawn into the piston bores from the fluid reservoir 24, yet prevent fluid discharge back into the fluid reservoir 24. The check valve 26 may be positioned in the transverse bore, alternatively as desired, to prevent fluid from entering the piston bores from the transverse bores. The check valve is preferably of conventional construction and operation, and therefore will not be further described.

In accordance with the present disclosure, the flow of hydraulic fluid to and from pumping piston 28 is manually controlled by the machine operator through a pump 52 which, in the embodiment disclosed, is hand operated. However, it is to be understood that the term manually as used in connection with the piston may be connected to a battery-type operation, or involve a toggle or trigger switch, or the like. It will also be understood that this tool may involve an automatic controller, or other understood equipment for automated operation. Pump in accordance with the present disclosure may be a variable displacement pump. It is to be noted at this point that a manually operable variable displacement pump, as the latter terminology is used herein, is intended to mean that the pump may be manually controllable by the operator to vary the fluid displacement thereof during a release operation, whereby the operator has control over the force applied to a threadless connector being disconnected. Pump, which is illustrated in FIG. 1 of the drawing, is representative of one such pump for the latter purpose. In this respect, pump includes a check valve 26 and a reservoir 24 from which the hydraulic fluid is to be pumped. The main body portion 20 includes a discharge passageway 33 by which the pump is connected to piston 28 through a coupling (not shown). Passageway 33 is provided with suction check valve 26 and discharge check valve 34, which controls the flow of hydraulic fluid from reservoir 24 and the flow of hydraulic fluid to the head portion.

The manual pump assembly portion includes a pumping piston 28 having a pump chamber 29, with the piston 28 manually reciprocable within the chamber 29. Chamber 29 is communicated by a passageway which communicates with inlet 44 and discharge 33 passages through a discharge port fitting 32. It is to be understood that the release tool 10 of the present disclosure may use other types of pumps (for example, two-stage centrifugal) and other types of valves, in different locations, where desired for other applications.

A discharge check valve 34 is provided in discharge passage 33 so that when pumping piston 28 rod is manually reciprocated, fluid will be drawn in from reservoir 24 through a supply line 27, inlet passage (not shown), suction check valve 26, and passageway 22; and out through discharge check valve 34, discharge passage 33 to inlet port 44.

The discharge check valve 34 is slidably positioned in an internal cavity in the discharge port fitting 32 to control the flow of the material, usually fluid contents of reservoir 24 pumped thereto for pressurized passage through the valve 34.

Turning more particularily to the head portion, lever 43 extends downwardly and is pivotally interconnected with the fixed arm of the engagement projection fingers 42 by means of pin 49. Lever 43 is pivotably attached to a fixed engagement arm. The fixed engagement arm is integrated into inlet port 44 on its outer end. Also housed within the body of the fixed arm of the engagement projection fingers 42 is inlet port 44 surrounding an internal wall or partition leading into pump chamber from the inlet port 44 there below. The hydraulic piston 46 is operably connected to the lever 43, and the piston 46 is adapted to be displaced in direction U in its chamber upon operator trigger of pressing pump 52.

The piston 46 is shown in its rest position in FIG. 1, and is pressed upward in the direction U via the hydraulic fluid filling the chamber from through the inlet port 44.

The pumping piston 28 is connected by a passage to the one-way discharge check valve 34 controlling flow of hydraulic fluid from the chamber 29 of the piston to discharge passage 33. The valve 34 may have its head engaged by a spring (not shown) acting to urge the head toward engagement with seat defined by an annular opening in the discharge port fitting 32. The discharge port fitting 32 connects discharge passage 33 with inlet port 44, and thereby chamber 29.

After the tool is inserted in the STC joint to be disconnected the operator then squeezes the "trigger". Once separated by the two engagement projection fingers 42, the pressure relief valve on the pump may be opened, allowing the pressurized fluid to decompress and flow back into the fluid reservoir.

INDUSTRIAL APPLICABILITY

During release, the threadless quick connect coupling release tool 10 has engagement projection fingers 42 inserted behind a release sleeve. During a disconnect operation utilizing the release tool 10, the tool is first inserted in the joint to be disconnected, and then the operator squeezes an activation lever 52.

During this squeezing action, fluid in a pumping piston cavity is then pushed through the discharge check valve and through to the discharge port fitting 32. The fluid may be oil, glycol-water mix, or the like. The fluid then travels through the hydraulic line connecting the hand pump to the release tool head portion 40. As the fluid flows into the head portion through the inlet port, it begins to activate the hydraulic piston. The piston then contacts the lever arm of the release tool head portion. The lever arm activates the separation of the two scissor-like finger projections. The separating action then may cause a latching ring type device to push forward into a groove (or the like) in the female half inner diameter, allowing a male shoulder and a female connector to be disconnected.

It is also important to note that the construction and arrangement of the elements of the threadless quick connect tubular coupling disconnection tool as shown in the preferred and other exemplary embodiments is illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, etc.) without materially departing from the novel teachings and advantages of the subject matter recited. For example, the length or width of the projections or fingers or head portions may be varied, and/or the nature or number of adjustment positions provided between the elements may be varied. It should be noted that the elements of the threadless quick connect tubular coupling disconnection tool might be constructed from any of a wide variety of materials that provide sufficient strength or durability, and in any of a wide variety of colors, textures and combinations. Accordingly, all such modifications are intended to be included within the scope of the present disclosure. Other substitutions, modifications, changes and omissions may be made in the design, operating conditions and arrangement of the preferred and other exemplary embodiments without departing from the sprit of the present disclosure.

What is claimed is:

1. A release tool for use with threadless quick connect couplings comprising:

a main body portion fixedly attached to a handle portion;

and a head portion having two engagement projection fingers, said two engagement projection fingers including an arm in pivotal engagement with a fixed arm by way of a rotation pin, said head portion being removably attached to said main body portion, and said head portion having an inlet port;

wherein said main body portion further comprises:

a discharge port fitting for receiving said inlet port;

a pumping piston in operable communication with said handle portion, a manually operated pump being connected to said pumping piston and an actuation handle being attached to the pump;

a discharge check valve in communication with said pumping piston; a reservoir in fluid communication with said pumping piston, said reservoir fluid flow regulated through a suction check valve; and a suction check valve positioned in said main body portion to prevent discharge back into said reservoir during hydraulic operation; and wherein a manually operated pressure release valve is operably releasable to remove pressure from the tool.

2. The release tool of claim 1, wherein the tool is hydraulically driven.

3. The release tool of claim 1, wherein the tool is pneumatically driven including an air compressor.

4. The release tool of claim 1, wherein the tool is mechanically actuated.

5. The release tool of claim 1, wherein a hydraulic piston is formed in said head portion, in operable communication with a lever, said lever forming one arm of said two engagement projection fingers.

6. The release tool of claim 5, wherein said two engagement projection fingers include a fixed arm, said fixed arm forming an operable chamber of said hydraulic piston.

7. The release tool of claim 6, wherein said two engagement projections fingers include the one arm in pivotal engagement with said fixed arm by way of a rotation pin.

8. The release tool of claim 6, wherein a leading edge of each arm of said two engagement projection fingers includes plane face surfaces which lie at an acute angle to one another and terminate in a transverse edge.

9. The release tool of claim 1, wherein said inlet port is integral to one of said two engagement projection fingers.

10. The release tool of claim 1, wherein a manually operated pump is connected to said pumping piston, and an actuation handle is attached to the pump.

11. The release tool of claim 1, wherein a leading edge of each arm of said two engagement projection fingers has a transverse edge for insertion engagement with a connector apparatus.

12. The release tool of claim 1, wherein said tool is configured to be operable on quick connect couplings attached to large diameter hoses.

13. The release tool of claim 1, wherein said handle is made of a comfort grip material.

14. A method for releasing a threadless quick connector tubular coupling, comprising the steps of:

providing a release tool inducing a main body portion fixedly attached to a handle portion, and a head portion having two engagement projection fingers, said two engagement projection fingers including an arm in pivotal engagement with a fixed arm by way of a rotation pin, said head portion being removably attached to said main body portion, and said head portion having an inlet port, wherein said main body portion further comprises, a discharge port fitting for receiving said inlet port, a pumping piston in operable communication with said handle portion, a manually operated pump being connected to said pumping piston and an actuation handle being attached to the pump, a discharge check valve in communication with said pumping piston, a reservoir in fluid communication with said pumping piston, said reservoir fluid flow regulated through a suction check valve; a suction check valve positioned in said main body portion to prevent discharge back into said reservoir during hydraulic operation, and wherein a manually operated pressure release valve is operably releasable to remove pressure from the tool;

placing engagement projection fingers of the head portion between said coupling and activating a lever arm to separate said engagement projection fingers.

* * * * *